United States Patent [19]

White et al.

[11] 4,420,157

[45] Dec. 13, 1983

[54] APPARATUS FOR PLAYING A GAME

[76] Inventors: Peter H. White; Patricia M. White, both of Apartado 164, Estepona, Malaga, Spain

[21] Appl. No.: 349,363

[22] Filed: Feb. 16, 1982

[30] Foreign Application Priority Data

Feb. 26, 1981 [GB] United Kingdom ..... 8106156

[51] Int. Cl.[3] ..... A63F 3/00

[52] U.S. Cl. ..... 273/272

[58] Field of Search ..... 273/272

[56] References Cited

U.S. PATENT DOCUMENTS

| | | | |
|---|---|---|---|
| 1,633,445 | 6/1927 | Gail | 273/272 |
| 3,117,789 | 1/1964 | Wiebe | 273/272 |
| 3,427,028 | 2/1969 | Abrahamsen | 273/272 |
| 4,014,548 | 3/1977 | Trilling | 273/272 |

FOREIGN PATENT DOCUMENTS

| | | | |
|---|---|---|---|
| 1107303 | 8/1955 | France | 273/272 |
| 7506392 | 12/1976 | Netherlands | 273/272 |
| 747598 | 4/1956 | United Kingdom | 273/272 |

*Primary Examiner*—Harland S. Skogquist
*Attorney, Agent, or Firm*—Browdy and Neimark

[57] ABSTRACT

Apparatus for playing a game of the kind in which competitors make conjoined words in crossword format comprises a game area in the form of a large square subdivided by mutually perpendicular sets of parallel lines into 225 smaller adjoining spaces. Also provided for each participant are one reserve area and one play area comprising forty-two squares or spaces and ten squares or spaces, respectively. Also provided is an initial allotment to each participant of an equal set of lettered playing pieces and one universal playing piece or "eagle" for disposal in the respective reserve areas. Each playing piece has one of only two different scoring values, that are denoted by its color, and scoring depends upon the total scoring value of the or each word formed in crossword format on the game area by each participant during alternate turns of play. A game played with the apparatus substantially completely eliminates the "luck" component associated with prior crossword format games and relies substantially solely upon the skill of the individual participants.

10 Claims, 8 Drawing Figures

Figure 1:
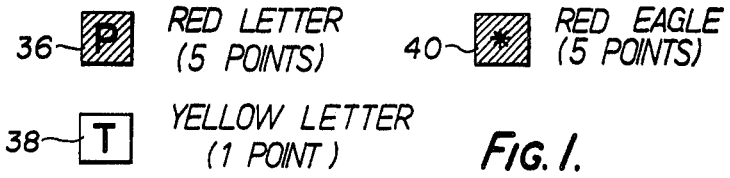

FIG.7
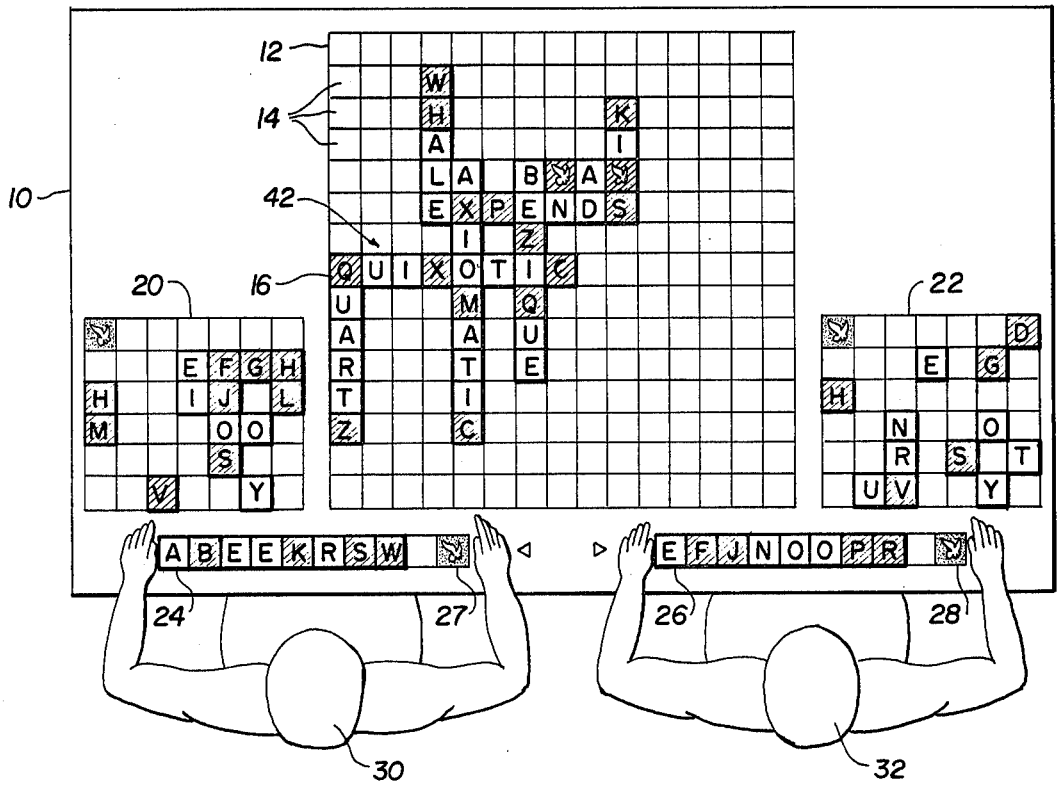
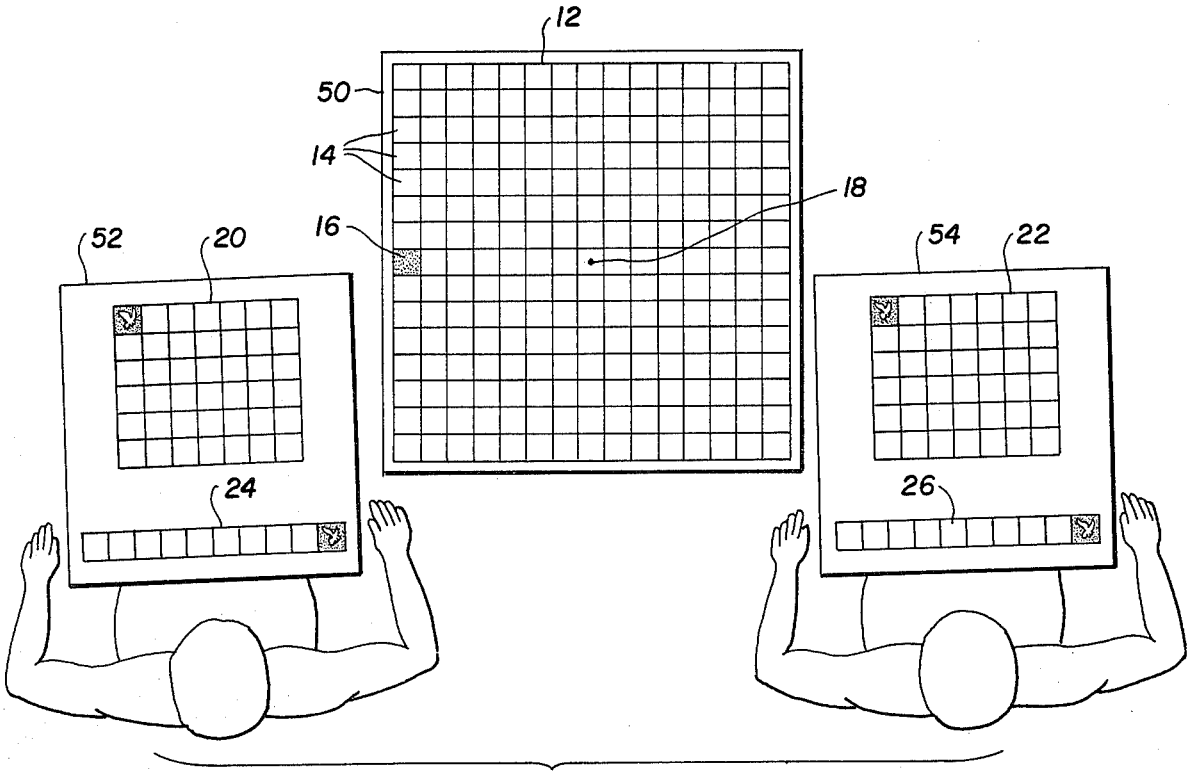
FIG.8

APPARATUS FOR PLAYING A GAME

The present invention relates to apparatus for playing a game, said game being of the nature of a "board" game although the use of a board, as such, is not essential to the apparatus or to the game which is intended to be played therewith.

A number of games are known which involve the use of lettered playing pieces that, during the playing of the game, are arranged on a marked board in crossword format. However, such games involve a considerable element of chance, as well as an element of skill, and, whilst this is initially acceptable to most players, the element of chance becomes increasingly frustrating to experienced players of such games who often become devotees to the extent of joining clubs of players that sometimes lead to national and/or international tournaments designed to find a "champion". Thus, the popularity of games of this kind is very great but one object of the present invention is to provide apparatus for playing a game of the general kind which has just been discussed but in which the element of chance is substantially completely eliminated. This overcomes the principal complaint of experienced players against games of the kind under discussion. A game played with apparatus in accordance with the invention involves a skill factor analogous to that required to play checkers rather than that required to play chess.

According to the present invention, there is provided apparatus for the playing of a game by only two participants, the apparatus comprising means that is planar when in use and that is marked with a single game area which defines a plurality of adjoining identically dimensioned spaces substantially all of which are plain and unmarked, said means further being marked to define one reserve area and one play area for use by each of the two participants, a plurality of playing pieces each of which is planar and is marked on both opposite sides with a single letter of the alphabet or with a symbol denoting universal use, each playing piece being assigned a scoring value, and rules for playing a game with the apparatus which rules require the initial allotment of an equal set of lettered playing pieces and one universal playing piece to each of the two gave participants for disposal in the respective reserve areas of said means, an initial secret selection by each participants of the same previously agreed number of not less than two and not more than ten of his/her allotted playing pieces for transfer from that reserve area to the respective play area, and the formation of conjoined words in crossword format in the adjoining spaces of the game area, such words yielding scores determined by the total letter values involved, the taking by the two participants of alternate turns using playing pieces selected from their respective play areas, and the subsequent restoral of the preselected number of playing pieces in their respective play areas at each turn by replenishment from the corresponding reserve areas, and wherein the rules also require all the playing pieces to remain fully visible to both participants once said initial secret selections thereby have been made in each game and the participants have signified that they are ready to continue that game.

For a better understanding of the invention, and to show how the same may be carried into effect, reference will now be made, by way of example, to the accompanying drawings, in which:

FIG. 1 illustrates three playing pieces in the form of two examples of lettered discs and a single universal usage disc, FIGS. 2 to 6 inclusive are illustrations showing stages in the progress of a game played with apparatus in accordance with the invention, FIG. 7 is a plan view of the game apparatus while in use, and FIG. 8 is a plan view of an alternative embodiment of game boards or cloths for use in the present invention.

It is intended that a commercial form of a game employing apparatus in accordance with the invention, and based upon at least the English language, should be known as "Pique" but it is pointed out that it is by no means essential that the game should be based only on the English language. Forms of the game using the same alphabet, but with variations such as the employment of accents, cedillas, umlauts and so on, for use in appropriate countries, are entirely possible as are forms based upon other languages and alphabets such as Russian/-Cyrillic, Arabic, Thai, Greek and so on. However, for the purposes of illustration, the present description and drawings will be limited only to the discussion of a form of the game based upon the English language and the Latin alphabet as used in English speaking countries.

In fact, the apparatus of the present invention can be employed to play any chosen one of nine varieties of the game "Pique". The particular variety of the game depends upon the number of letter/universal playing pieces that are currently held in each participant's play area, as will be explained in detail below, and this number, in accordance with the rules, can be any chosen one between 2 and 10, inclusive. Obviously, the participants agree upon which variety of the game is to be employed before play commences and it has been found that each of the different varieties of "Pique" gives an interesting and challenging game.

The apparatus which is used in each of the nine varieties of the game "Pique" comprises means marked with a game area which denotes a plurality of plain and unmarked adjoining spaces. This means may be in the form of a suitably marked board 10, which may be foldable, if desired, or may preferably be in the form of a play-cloth printed or otherwise marked to show the game area. The game area 12 is square in shape and is subdivided by two mutually perpendicular sets of spaced but parallel lines into 225 equal squares 14 in a $15\times15$ arrangement. The size of the whole game area 12 and of each playing square 14 is not critical but is, of course, related to the size of the playing pieces so that each square disc-formation playing piece substantially exactly fits one of the small play squares. 224 of the adjoining play squares or spaces are plain and unmarked whereas the 225th, 16, being the 8th square from top or bottom along the left-hand row of squares in the whole game area, is marked in any desired manner as a starting square. It is not essential that the game area should comprise 225 squares and it may have as few as 100 ($10\times10$) or as many as 256 ($16\times16$). The marked starting square may be one, or the other, of the two center squares of the left-hand vertical row of squares when there is an even total number of squares.

The play cloth or board 10 upon which the game area 12 is marked preferably also includes two reserve areas 20, 22 and two play areas 24, 26, there being one reserve area and one play area for each of the two game participants 30, 32. Conveniently, but not essentially, the two reserve areas 20-22 are marked at the left and right sides of the game area 12 and the two play areas 24, 26 are marked beneath the respective reserve areas 20, 22. The cloth or board 10 is preferably set out in this way so that the two participants 30, 32 can conveniently sit side-by-side to enable them clearly to see each other's moves. This arrangement is greatly preferred (since it avoids having to keep "turning" the game area to prevent one participant being disadvantaged by playing upside down) but is not, however, essential and the reserve areas and play areas can, if preferred, be repositioned to enable the two participants to sit opposite one another. In addition, it is by no means essential that the reserve areas and play areas should be marked on the same cloth or board as carries the game area. If preferred, each participant may have a separate cloth or board 52, 54 carrying his/her own reserve area 20, 22 and play area 24, 26, with a third cloth or board 50 carrying the game area (as shown in FIG. 8), or two such additional cloths or boards may be provided for each participant, one being marked with that participant's reserve area and the other with the same participants play area (not shown). In any case, each reserve area comprises a plurality of squares which is equal in number to the total allotment of playing pieces 34 that each participant receives at the commencement of each game. It is preferred that there should be 42 of these "reserve" squares 34 marked as follows, the number following each letter of the alphabet being the number of squares carrying that letter: A-3, B-1, C-1, D-1, E-4, F-1, G-1, H-2, I-3, J-1, K-1, L-1, M-1, N-2, O-3, P-1, Q-1, R-2, S-2, T-2, U-2, V-1, W-1, X-1, Y-1, Z-1. In addition, the 42nd "reserve" square 36 is marked with a symbol denoting a universal usage playing piece. It is preferred that this universal usage playing piece should carry a pictorial representation of an eagle and it is accordingly hereinafter referred to as an/the "eagle" although it will be quite clear that any other desired symbol (such as the asterisks in FIGS. 2–6) could equally well be employed. Preferably, the 84 playing pieces 34 (42 per participant) are differently colored to indicate the scoring values that are assigned to them and, if desired but not essentially, the squares of each reserve area 20, 22 may be similarly colored.

Each play area 24, 26 comprises ten squares which are plain and unmarked except that, if desired, the eagle symbol may appear at the right-hand side of each play area square 27, 28 and one of those squares may be marked for the reception of the corresponding eagle.

Turning now to the playing pieces 34, each of those square disc-like playing pieces 34 is of planar formation and is marked on both opposite sides with one of the letters of the alphabet, or with the eagle symbol. It has already been mentioned that each playing piece 34 is assigned a corresponding scoring value and it is noted here that there are only two different scoring values, one such value being 5 points and the other being 1 point. The playing pieces are basically of two different colors which colors correspond to either "five points" or "one point". It is preferred that those playing pieces 36, 40 which have a points value of five should be colored red whereas those playing pieces 38 which have a points value of one should be colored yellow. In the example that is being described, letters A, E, I, N, O, R, T, U and Y correspond to playing pieces that will be colored yellow and are therefore assigned a scoring value of one point each whereas all the playing pieces that correspond to the other letters of the alphabet, and also the eagle 40 in each participant's set of playing pieces, will be colored red and will have a scoring value of five points. The particular way in which the coloration is marked on the square discs that afford the playing pieces is of no great importance, provided that it is clear and unmistakable.

In a game played in accordance with the apparatus that has so far been described, there are only two participants 30, 32 who take alternate turns, their lettered playing pieces 34 being deployed from their respective reserve areas 20, 22, via their respective play areas 20, 28, onto the single game area 12 to form conjoined words 42 in crossword format in the adjoining spaces of the game area. In a similar manner to crossword puzzles, all edge-to-edge abutting playing pieces must form a word or words, there being no word formation via corner-to-corner abutting playing pieces. As will become apparent from the example of a game played by the use of apparatus in accordance with the invention that is given below, scoring is purely numerical, the winning participant being the one who has the highest score when each game finishes.

Each participant has one universal playing piece or eagle 40 and, when it is his/her turn to play, said eagle may be used in place of any letter of the alphabet when forming a word or words in the game area. The rules require each participant, when using his/her eagle in place of a lettered playing piece, to declare verbally what the letter represented by the eagle is. Each participant may, when it is his/her turn to play, recover one or both eagles from the game area by substituting the or each letter temporarily represented by that eagle by the actual previously declared letter taken from his/her play area. However, as an alternative which may be agreed upon before play commences and which adds considerably to the complexity of the game, substitution may take place where one participant had used his/her eagle to represent one letter but where the substitution of a different letter from the other participant's play area would result in an allowable word. For example, one participant could employ his/her eagle to represent the last letter of the word "LOOK". The other participant, having a playing piece lettered "P" but not having a playing piece lettered "K", could substitute the "P" for the eagle thus making the acceptable word "LOOP". In either way of playing the game, the recovered (in the case of his/her own eagle) or captured (in the case of the opponent's eagle) piece may be used in the same turn of the game by the participant recovering/capturing one or both eagles or may be kept in the participant's play area until required for use in a subsequent turn. It will be remembered that each play area may have a position marked for the corresponding eagle. If one participant temporarily captures the other participant's eagle, then it is placed anywhere convenient in the play area of said one participant to be ready for use as soon as appropriate.

At the commencement of a game, or series of games, both participants must mutually agree upon the use of a single dictionary which dictionary then becomes the standard reference dictionary throughout the game, series of games, competition, tournament or the like. The agreed dictionary may be referred to at any time throughout the or each game whether to check upon the accuracy of a doubtful or disputed word or to find a suitable one. Ideally, and particularly as play becomes more competitive and the participants become more expert, each participant will wish to have a copy of the mutually agreed dictionary for his/her own use. In the English language/Latin alphabet form of the game that is being described, the use of the Penguin English Dictionary is recommended since it is contemporary, colloquial and concise whilst not being too large for easy handling and storage. Any word of two letters or more that appears in the mutually agreed dictionary may be used in each game with the only exceptions of prefixes and suffixes, hyphenated words, words containing apostrophies and initial letter representations of words such as, for example, SOS, OK. Any word that does not appear in the mutually agreed dictionary may not be used in any game even though it is known to one or other participant or to both of them. If a participant puts down an incorrect word (i.e. not in the agreed dictionary) which is then successfully challenged by the opponent, the erring participant may withdraw the incorrect word and replace it with another without loss of score or turn of play. A challenge of this kind may only be made at the time at which the allegedly incorrect word is first put down on the game area. As soon as the turn concerned is over and the next turn commences, no challenge can be made and the word is question remains in the game area, incorrect or not.

It has already been mentioned that nine different varieties of the game "Pique" are playable in accordance with the number of lettered playing pieces maintained in each participant's play area by replenishment from the corresponding reserve area. It will now be assumed that the variety in which eight playing pieces are maintained in each play area is to be employed, this variety of the game conveniently being known as "Pique-Eight". The other varieties of the game will be discussed below. The game opens with each participant being given an initial allotment of an equal set (41) of the lettered playing pieces and one eagle, the distribution of the letters in this set of 42 pieces being as indicated in detail above. Each participant then conceals his/her reserve area and play area from the opposing participant. Each of them then makes an initial secret selection of eight (in this variety of the game) playing pieces in the reserve area for transfer to the corresponding play area with a view, of course, to the formation of a high scoring word. Once both participants have made this initial secret selection, they signify verbally that they are ready to continue the game and, from that time onwards, the concealment of the play and reserve areas in withdrawn and the rules require that all the playing pieces in the single game area and the two play areas and reserve areas remain fully visible to both participants until the end of the game concerned.

Play is ready to begin at this point. The two participants may toss a coin to decide who has first turn but participants who play regularly, or who are playing a series of games (for example, best of three, five, seven) may, by mutual agreement, allot the first turn in each game alternately, to the loser of the preceding game or to the winner of the preceding game.

The first participant to take a turn forms a word from the pieces in his/her play area, said word being entered horizontally with its first letter on the starting square 16 whose position has been discussed above. This commencing word may, of course, include the corresponding participant's eagle if so desired. At each following turn, the participant concerned may pick up an eagle (or both of them, if appropriate) from the game area and substitute a lettered playing piece corresponding to the previously declared letter for the or each eagle, the lettered playing piece or pieces being taken from the participant's play area and making the originally intended word. In the previously discussed agreed circumstances in which the letter represented by an eagle is not "declared", a lettered playing piece designed to form any word that is acceptable from the point of view of the reference dictionary may be employed. An example of this deviation from the rules, that may be agreed upon by the two participants, is given above but it should be remembered that, where two or more words cross one another and at least one eagle is common to two such crossing words, a letter substitution to produce a word different from that originally intended must be correct from the point of view of both of the words involved. When a substitution has been made, the participant who obtains one or both eagles places it or them in his/her play area for immediate use in the same turn or for use in a subsequent turn of the game.

Obviously, there will be occasions where no eagle substitution takes place in which case the participant proceeds to the next part of his/her turn, this being the "second" part of that turn if an eagle substitution has been made. This part of the turn involves putting down any or all of the pieces in his/her play area onto the game area to form at least one word which will be in crossword format by being perpendicularly conjoined with at least one other word. Alternatively, an existing word on the game area may be extended by adding letters to its beginning and/or to its end. Any words that are additional, at each turn of the game, to the word which is put down in that turn will have been formed by other letters or words touching it in abutting edge-to-edge relationship and each word so produced, including the "put down" word, scores the total scoring value for each word produced in the turn concerned, the scoring values being set forth above and it being remembered that each red playing piece scores five points whilst each yellow playing piece scores one point. It has already been mentiond that the first word to be put down on the game area must be horizontally disposed with its first letter on the starting square but, clearly, subsequent words may be either vertically or horizontally disposed. If a participant is unable to put down any letters whatsoever during his/her turn to play, he/she will "pass" and the opponent will then commence his/her turn to play. A participant is not allowed to choose to "pass" whilst holding letters or an eagle which can be used during one of his/her turns to play.

The last part of each turn, which will be the third part of that turn if a "letter for eagle" substitution has been made as a first part thereof, involves the participant in selecting playing pieces from his/her reserve area to replenish the corresponding play area to bring it to a total of eight (in this variety of the game) playing pieces. Up to this point, the participant may change his/her mind and vary any of the parts of the turn concerned including the replenishment step now under consideration. However, pieces already in the play area at the commencement of the turn may not be returned to the reserve area; only, as a change of mind, pieces transferred from the reserve area to the play area during the turn concerned. At the end of this part of the turn, the participant must advise his opponent that he/she has completed the turn by saying "PLAY", "FINISHED" or the like and, after having done this, no changes of mind are allowable. The total score for the turn is then recorded and the opponent commences his/her turn in the same way, as described above.

The end of the game is reached when all of the playing pieces belonging to one participant are deployed on the game area even though, at this time, the opponent still has pieces remaining in his/her play area or play area and reserve area. Secondly, the game ends when one of the participants verbally resigns, thus conceding defeat. Thirdly, the game ends if both participants are unable to place any more of their pieces on the game area. If only one of the two participants should arrive at this condition, the opponent continues playing, taking successive turns, until either the first participant can recommence placing pieces or the opponent, also, can no longer continue. In a version of the game which will be discussed below, play continues for a specified period of time, which it is suggested should be one hour, and the game ends at the expiry of this period provided only that each participant has had the same number of turns. If the starting participant is taking a turn at the end of the specified period, the game is extended beyond that period by a closing turn of the opponent.

There is no provision for bonus points to the last participant and all unplayed pieces (not deployed in the game area) do not score. The participant having the highest score at the end of each game is the winner of that game.

The above passages of description refer to the playing of Pique-Eight were each play area commences with eight playing pieces and is replenished to that number, from the corresponding reserve area, after each transfer of pieces to the game area until, depending upon the particular game, no pieces remain in the reserve area. The other varieties of Pique may be designated as Pique-Two to Pique-Seven inclusive, Pique-Nine and Pique-Ten. Pique-Two and Pique-Three involve commencing with corresponding numbers of playing pieces in each play area and the maintenance of such numbers, by replenishment from the respective reserve areas, as the game progresses. Although these varieties of Pique are suitable for the youngest players and as a quick introduction to the complete beginner, they are by no means "simple" varieties, being no more easy to play, by experienced participants, than, say, Pique-Eight. Most participants, even including young children (who will generally not appreciate the subtleties of Pique-Two and Pique-Three), will usually rapidly progress to more advanced varieties (in some respects) of the game. When playing Pique-Two or Pique-Three, it is recommended that the center square 18 of the complete game area 12 should be used to commence, placing the last letter of the first word of the game on that square instead of using the marked starting square 12 as discussed above. When there is an even total number of squares, and thus no "center" square, an agreed one of the center four squares may be chosen for starting purposes or one of those four may be appropriately marked for this purpose. It is recommended to play Pique-Two or Pique-Three as a time limit game, the duration of the game not necessarily being as long as an hour, particularly when it is to be played by young children.

Pique-Four is a little more complex to play than Pique-Two or Pique-Three and, in this case, the marked starting square may be employed or, if preferred, the center square of the whole game area subject to the points discussed above. Once again, however, a time limit version of the game is recommended with a view to obtaining a satisfactory ending. This variety of Pique introduces the younger or inexperienced player to some of the complexities of Pique-Eight, the latter being one of the varieties which can be chosen for use in match-play games.

Pique-Five, Pique-Six, Pique-Seven and Pique-Eight are progressively more complex and interesting, though not more difficult to play. When playing these varieties, the starting square of the game area, as discussed above, should be employed to commence each game. Pique-Nine and Pique-Ten are, of course, still more complex than the other varieties of the game and should be commenced from the starting square of the game area. These latter varieties of the game are particularly suitable for mature and experienced players.

The duration of the game may be determined as discussed above where the game comes to a natural conclusion in one of the ways described. Whichever variety (Pique-Two to Pique-Ten) is being played, this "natural ending" game is considered as being the full game. A "short game" variation may be employed by reducing the number of letters allotted to each participant and placed in the corresponding reserve area before play commences. Wherever, as listed above, the allocation for the full game is more than one letter, that allocation is reduced by one. This reduces each participant's total number of playing pieces by ten so that he/she will commence each game with thirty-two, rather than forty-two, playing pieces. The already discussed time-limit version can be applied to any variety of Pique to terminate the game after a fixed period, subject only to each participant having an equal number of turns. The time-limit version of the game is particularly recommended when Pique-Two, Pique-Three or Pique-Four is to be played but is by no means limited to these varieties of the game and can be used with any of the more complex varieties. Although the period of one hour is usually satisfactory, it is by no means mandatory and may be either increased or reduced, a reduction often being appropriate when very young players are involved.

There now follows a description, related to the accompanying drawings, of an example of the opening turns in a game of Pique-Eight. FIG. 1 of the drawings shows three lettered playing pieces, being a red playing piece 36 lettered "P" (scoring five points), a yellow playing piece 38 lettered "T" (scoring one point) and a red "Eagle" playing piece 40 (scoring five points), a simple asterisk being used in the drawings FIGS. 1–6 in place of a representation of an eagle.

Each participant in this game of Pique-Eight is allotted an equal set of forty-two playing pieces as listed earlier in this description and, initially, conceals his/her play area and reserve area from the opposing participant and, whilst these areas are still concealed, makes an initial transfer of eight playing pieces from his/her reserve area to the play area with a view to using all eight playing pieces in a high scoring word. This word may, or may not, include the participant's eagle.

Figure 2:
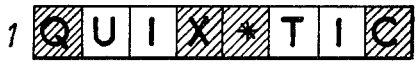

FIG. 2 of the drawings shows the opening participant's first turn where the word "QUIXOTIC" is placed in the game area positioning the opening letter "Q" on the starting square of that game area, the word being entered horizontally in accordance with the rules. The number "1" is marked to a left of the word in FIG. 2 to show that it is the first turn in the game. The participant uses his/her eagle in place of the letter "O" in "QUIXOTIC" but, before deciding to do this, checks the fully visible (after the initial secret selection) play and reserve areas of the opponent to ensure that said opponent does not have a playing piece lettered "O"

arrayed in his/her play area. It will be seen from the information given above that the word "QUIXOTIC" scores twenty-four points with the eagle standing in for the letter "O".

Figure 3:
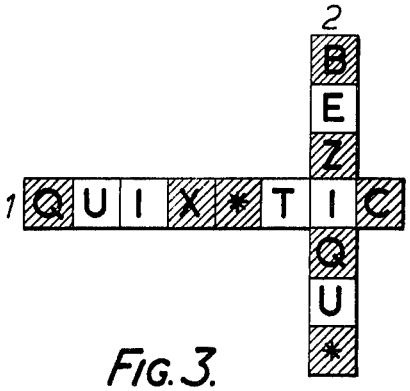

FIG. 3 shows the second participant's first turn on the game area and the number "2" is marked above the word "BEZIQUE" which the second participant puts down to identify that word as being played in the second turn of the game. It will be noted that the second participant uses his eagle in place of the closing "E" of "BEZIQUE". The second participant scores twenty-three points in this second turn of the game.

Figure 4:
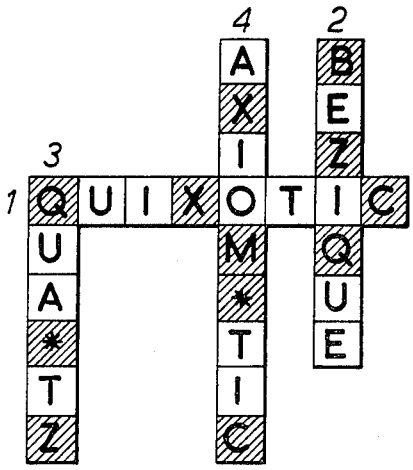

FIG. 4 of the drawings shows the words that are put down in the game area by the first and second participants, respectively, at the third and fourth turns. At the third turn, the first participant picks up his/her eagle from the word "QUIXOTIC", substituting the playing piece lettered "O" from his/her play area. He/she then puts down the word "QUARTZ" using his/her retrieved eagle instead of the letter "R". The score for the word "QUARTZ" is eighteen points so that the first participant, at this stage, has a total score of forty-two points, The second participant, in the fourth turn of the game, picks up his/her own eagle from the word "BEZIQUE" and substitutes a playing piece lettered "E" from his/her play area. He/she then puts down the word "AXIOMATIC" in a vertical direction conjoining "AXIOMATIC" to "QUIXOTIC" at the letter "O". The retrieved eagle is used in place of the second "A" of "AXIOMATIC". The score for "AXIOMATIC" is twenty-five points so that the second participant, at this stage of the game, has a total score of forty-eight points.

Figure 5:
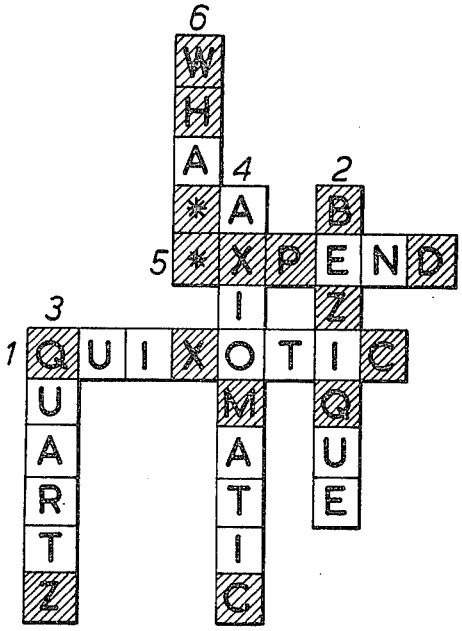

FIG. 5 of the drawings illustrates the fifth and sixth turns of the game (as regards the words placed on the game area) by the first and second participants, respectively. In the fifth turn of the game, the first participant picks up his/her eagle from the word "QUARTZ" and substitutes a playing piece bearing the letter "R" from his/her play area. He/she then puts down the word "EXPEND" on the game area using the recovered eagle instead of the initial "E" of "EXPEND". The first participant thus scores five points making a total score, at this stage, of sixty-four points. The second participant, in the sixth turn of the game, picks up his/her eagle from the word "AXIOMATIC" substituting the second letter "A" therein by a correspondingly lettered playing piece from his/her play area. He/she then puts down the word "WHALE" in a vertical direction using the recovered eagle in place of the letter "L" and additionally taking advantage of the first participant's eagle at the beginning of "EXPEND" as the final "E" of "WHALE". It should be particularly noted that the second participant also forms the word "LA", increasing his score accordingly since there is no limit to the number of words that may be made during the "put down" part of a turn providing that all edge-to-edge touching letters form allowable words of not less than two letters. The second participant accordingly scores twenty-one points for "WHALE" and six points for "LA" making twenty-seven points and a running total of seventy-five points.

Figure 6:
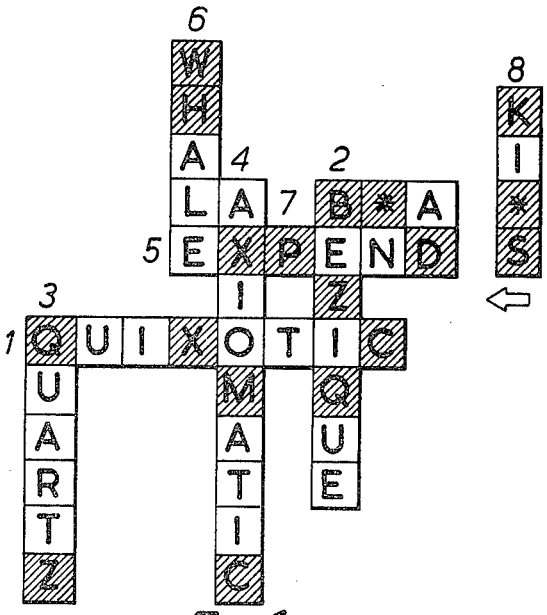

FIG. 6 of the drawings illustrates the seventh and eighth turns of the game by the first and second participants, respectively, so far as the words put down on the game area are concerned. In the seventh turn, the first participant picks up his/her eagle at the beginning of the word "EXPEND" and substitutes a letter "E" from his/her play area. He/she then puts down the word "BOA" in a horizontal direction employing the first letter of "BEZIQUE" as the first letter of "BOA" and using the recovered eagle as the centre letter "O" of "BOA". The first participant thus makes three words "BOA", "ON" and "AD", scoring eleven, six and six points, respectively, adding up to twenty-three and making a running total of eighty-seven points. The second participant, in the eighth turn of the game, picks up his/her eagle from the word "WHALE" substituting a playing piece lettered "L" from his/her play area. He/she then puts down the word "KITS" which is shown in FIG. 6 as spaced a short distance to the right from the remainder of the already placed words to clarify the action at this stage. He/She uses the recovered eagle as the letter "T" of "KITS" and it will be apparent that he/she forms three words, "KiTS", "BOAT" and "EXPENDS". These three words score sixteen points, sixteen points and twenty-three points, respectively thus adding fifty-five points to the second participant's running total and accordingly enlarging that running total to 130 points.

FIG. 7 shows the entire square board 10 and the participants 30, 32 as the board appears after the eighth turn described above.

Play continues similarly after the eighth turn and it is believed that, in the light of this explanation of an example game and the preceding description, the ways in which the nine varieties of the game are played will be quite clear. The apparatus which has been described and the varieties of the game "Pique" that may be played therewith enable instructive and enthralling games to be played without there being any significant element of luck involved as occurs in games of the known kind that are briefly discussed at the beginning of this description where luck can play a large part in the outcome of each game and thus be most frustrating to experienced players. The basic objective of a participant in a game of "Pique" is to finish that game by putting down all his/her playing pieces in accordance with a predetermined plan, remaining ahead in the running total score. It is perfectly possible for a participant to end the game himself/herself, inadvertently, whilst still being behind in total score. Since an ending of this kind achieves nothing for the participant and is somewhat ignominious, resignation is recommended as soon as it is realised that such a situation is becoming inevitable.

An experienced participant should plan ahead for the whole period of a game from beginning to end and should try to phase his/her pieces into play in a predetermined order and so as to achieve the maximum possible scoring. A close eye should be kept upon the particular playing pieces held in the reserve area (initially sixteen vowels, twenty-five consonants and one eagle), endeavoring to bring the vowels and consonants into play substantially in proportion to the original allotment throughout the game. Without such foresight, a participant's vowels or reasonably playable vowel-consonant combinations may be exhausted before the end of the game is reached, thus risking being unable to take turns with a consequent loss of score.

Since a participant can see his/her opponent's playing pieces throughout the game (except solely at the commencement thereof), defensive play is possible. For example, a participant can work out an opponent's likely moves and block them with his/her own play or, sometimes, exploit those moves with high scoring words. Intelligent anticipation can often work out where an opponent may use his/her eagle, this sometimes being preventable by appropriate pick-up tactics. Generally speaking, defensive play can involve putting down words that cannot easily, if at all, be extended; for example, by pluralization. This prevents an opponent putting down a word and incidentally making at least one other word by extension, thus limiting the opponent's score. If the eagle is properly used, it is of major importance to a participant. Ideally, it should not be used to represent a letter already held by an opponent in his/her play area. Since it is a red playing piece with a score of five, its greater scoring potential can be utilized to the maximum by employing it in place of yellow single-point playing pieces as often as possible. If the opportunity arises to make two words at one "put down", the linking letter of those conjoined words may advantageously be represented by the eagle, thus obtaining its score of five points, twice. It is important to remember that the eagle can be used in place of a lettered playing piece in a participant's reserve area. If, when a participant has used his/her eagle as part of a word entered in the game area, the same participant transfers a playing piece carrying the substituted letter from his/her reserve area to the play area, said participant will then be able to recover his/her own eagle at the next turn. Provided a participant ensures that his/her opponent does not have a letter in his/her play area that is to be represented by said participant at the time at which the participant puts down a word containing his/her eagle as a substitute for that letter, the opponent will never have a letter available in his/her play area to substitute for the participant's eagle. If a participant remembers always to pick up his/her eagle and to bring it back into his/her play area as the first following action, then, at least in the earlier stages of a game, the opponent should never be able to capture that eagle.

The closing stages (game-end) of a game are probably the most important part thereof although the whole game must be planned in advance and be played in accordance with that plan if a participant is to be the winner. The closing stages might be considered as covering the playing of approximately the last twenty-five percent of the initially allotted forty-two playing pieces. Obviously, the number of letters remaining in each participant's reserve area towards the end of a game becomes severely restricted as does the length of words that can possibly be made. Careful planning dictates the retention for this part of the game of letters which can be used in short, simple words, and particularly two-letter words, these being the shortest words which the rules allow to be produced in the game area. Certain consonants, such as J, K, Q, V and Z are particularly difficult to use in the closing stages of a game and are a significant disadvantage if still held. It is therefore prudent to use these consonants as early as possible during a game and certainly well before the closing stages thereof are reached.

The letters "S" and "D" are particularly useful in the closing stages of a game since they can be added to the ends of words to produce double-word put downs and scoring. Thus, generally speaking, it is advantageous to retain these letters in the reserve area until the closing stages of the game when they will be found to facilitate a smooth run out of playing pieces from the reserve area which is essential to a participant in this phase of the game if scoring is to continue.

Although it has been emphasized above that a participant should retain his/her eagle for as long as possible for employment in a number of different words, and, in particular, should not lose it to the opponent, a point comes during the closing stages of a game when, along with all the other playing pieces, it must be put down in the game area as a permanency. A sacrifice play can sometimes be made with the eagle at this stage using it to make a high score such as a double-word score to ensure a scoring lead as a last or, perhaps, penultimate, move in the game. Sometimes, the eagle sacrifice becomes necessary several moves before a competitor finishes his/her turns and, in such a case, the main objective should be to achieve as high a score as possible to put the participant into the lead, if at all possible, before his/her scoring terminates. Naturally, the opponent's closing moves must also be watched with a view, if possible, to blocking any high scoring eagle-sacrifice turn in the opponent's last move, or in one of his/her last moves.

We claim:

1. Apparatus for the playing of a game by only two participants, the apparatus comprising means that is planar when in use and that is marked with a single game area which defines a plurality of adjoining identically dimensioned spaces substantially all of which are plain and unmarked, said means further being marked to define one reserve area and one play area for use by each of the two participants, a plurality of playing pieces each of which is planar and is marked on both opposite sides with a single letter of the alphabet or with a symbol denoting universal use, each playing piece being assigned a scoring value, and rules for playing a game with the apparatus which rules require the initial allotment of an equal set of lettered playing pieces and one universal playing piece to each of the two game participants for disposal in the respective reserve areas of said means, an initial secret selection by each participant of the same previously agreed number of not less than two and not more than ten of his/her allotted playing pieces for transfer from that reserve area to the respective play area, and the formation of conjoined words in crossword format in the adjoining spaces of the game area, such words yielding scores determined by the total letter values involved, the taking by the two participants of alternate turns using playing pieces selected from their respective play areas, and the subsequent restoral of the preselected number of playing pieces in their respective play areas at each turn by replenishment from the corresponding reserve areas, and wherein the rules also require all the playing pieces to remain fully visible to both participants once said initial secret selections thereby have been made in each game and the participants have signified that they are ready to continue that game.

2. Apparatus according to claim 1, wherein the means marked with a game area comprises a foldable cloth.

3. Apparatus according to claim 2, wherein the same foldable cloth is also marked with the two reserve and two play areas.

4. Apparatus according to claim 2, wherein the two reserve and two play areas are marked on at least one foldable cloth that is separate from the cloth exhibiting the game area.

5. Apparatus according to claim 1, wherein said means comprises at least one board.

6. Apparatus according to claim 1, wherein the game area is square and the adjoining spaces of same game area are defined by two sets of spaced but parallel lines arranged with the lines of said sets arranged in successively crossing relationship with one another, and wherein said sets of lines extend parallel to the respective opposite edges of the square game area and define, in conjunction with sid edges, 225 square spaces of which 224 are plain and unmarked whereas 1 space is marked to indicate its use as a "starting" square for a game that is to be played with the apparatus.

7. Apparatus according to claim 6, wherein the single space that is marked to denote the "starting" square is the 8th space of the left-hand vertical row of spaces of the game area counting from either the top space or the bottom space of said row.

8. Apparatus according to claim 1, wherein each playing piece is colored to denote its scoring value and only two "scoring value" colors are employed throughout all of the playing pieces.

9. Apparatus according to claim 6, wherein each planar playing piece is of square configuration, substantially matching in size the square spaces of said game area, and wherein each play area defines ten spaces shaped to receive a maximum of ten of the playing pieces.

10. Apparatus according to claim 1, wherein each reserve area defines forty-two spaces, each space being marked with one letter of the alphabet or with said symbol denoting universal use whereby said reserve areas can receive the initial allotments of equal sets of lettered playing pieces and one universal playing piece in a positionally predetermined array.

* * * * *